US007946815B2

(12) United States Patent
Liang

(10) Patent No.: US 7,946,815 B2
(45) Date of Patent: May 24, 2011

(54) AIRFOIL FOR A GAS TURBINE ENGINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 638 days.

(21) Appl. No.: 11/728,885

(22) Filed: Mar. 27, 2007

(65) Prior Publication Data

US 2008/0240919 A1 Oct. 2, 2008

(51) Int. Cl.
*F01D 9/02* (2006.01)

(52) U.S. Cl. ..... 416/97 R

(58) Field of Classification Search ..... 415/115; 416/96 R, 97 A, 97 R
See application file for complete search history.

(56) References Cited

U.S. PATENT DOCUMENTS

| | | | | |
|---|---|---|---|---|
| 3,767,322 | A * | 10/1973 | Durgin et al. | 416/97 R |
| 4,786,234 | A * | 11/1988 | Readnour | 416/97 R |
| 5,375,972 | A | 12/1994 | Gray | |
| 5,667,359 | A * | 9/1997 | Huber et al. | 416/96 A |
| 5,931,638 | A | 8/1999 | Krause et al. | |
| 6,174,133 | B1 | 1/2001 | Bunker | |
| 6,254,334 | B1 | 7/2001 | LaFleur | |
| 6,402,470 | B1 | 6/2002 | Kvasnak et al. | |
| 6,478,535 | B1 | 11/2002 | Chung et al. | |
| 6,607,355 | B2 | 8/2003 | Cunha et al. | |
| 2005/0095118 | A1 | 5/2005 | Liang | |
| 2006/0002788 | A1 | 1/2006 | Liang | |
| 2006/0275119 | A1 | 12/2006 | Liang | |

* cited by examiner

*Primary Examiner* — Edward Look
*Assistant Examiner* — Jesse Prager

(57) ABSTRACT

An airfoil is provided for a turbine of a gas turbine engine. The airfoil comprises: an outer structure comprising a first wall including a leading edge, a trailing edge, a pressure side, and a suction side; an inner structure comprising a second wall spaced from the first wall and at least one intermediate wall; and structure extending between the first and second walls so as to define first and second gaps between the first and second walls. The second wall and the at least one intermediate wall define at least one pressure side supply cavity and at least one suction side supply cavity. The second wall may include at least one first opening near the leading edge of the first wall. The first opening may extend from the at least one pressure side supply cavity to the first gap. The second wall may further comprise at least one second opening near the trailing edge of the outer structure. The second opening may extend from the at least one suction side supply cavity to the second gap. The first wall may comprise at least one first exit opening extending from the first gap through the pressure side of the first wall and at least one second exit opening extending from the second gap through the suction side of the second wall.

19 Claims, 4 Drawing Sheets

AIRFOIL FOR A GAS TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to an airfoil for a turbine of a gas turbine engine and, more preferably, to an airfoil having improved cooling.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gases travel to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gases expand through the turbine, the working gases cause the blades, and therefore the shaft and disc assembly, to rotate.

Combustors often operate at high temperatures. Typical combustor configurations expose turbine vanes and blades to these high temperatures. As a result, turbine vanes and blades must be made of materials capable of withstanding such high temperatures. In addition, turbine vanes and blades often contain internal cooling systems for prolonging the life of the vanes and blades and reducing the likelihood of failure as a result of excessive temperatures.

Typically, turbine vanes comprise inner and outer endwalls and an airfoil that extends between the inner and outer endwalls. The airfoil is ordinarily composed of a leading edge and a trailing edge. The vane cooling system receives air from the compressor of the turbine engine and passes the air through the airfoil.

Conventional turbine vanes have many different designs of internal cooling systems. While many of these conventional systems have operated successfully, the cooling demands of turbine engines produced today have increased. Thus, an internal cooling system for turbine vanes as well as blades having increased cooling capabilities is desired.

SUMMARY OF THE INVENTION

In accordance with a first aspect of the present invention, an airfoil is provided for a turbine of a gas turbine engine. The airfoil comprises: an outer structure comprising a first wall including a leading edge, a trailing edge, a pressure side, and a suction side; an inner structure comprising a second wall spaced from the first wall and at least one intermediate wall; and structure extending between the first and second walls so as to define first and second gaps between the first and second walls. The second wall and the at least one intermediate wall define at least one pressure side supply cavity for receiving a cooling fluid to cool at least a portion of the pressure side of the first wall and at least one suction side supply cavity for receiving a cooling fluid to cool at least a portion of the suction side of the first wall. The structure extending between the first and second walls defines the first and second gaps between the first and second walls such that the first gap extends from generally the leading edge of the first wall toward the trailing edge of the first wall and may be defined at least in part by the pressure side of the first wall. The second gap extends from generally the trailing edge of the first wall toward the leading edge of the first wall and may be defined at least in part by the suction side of the first wall.

The second wall may include at least one first opening near the leading edge of the first wall. The first opening may extend from the at least one pressure side supply cavity to the first gap. The second wall may further comprise at least one second opening near the trailing edge of the outer structure. The second opening may extend from the at least one suction side supply cavity to the second gap.

The first wall may comprise at least one first exit opening extending from the first gap through the pressure side of the first wall so as to allow cooling fluid to exit the first gap and at least one second exit opening extending from the second gap through the suction side of the second wall so as to allow cooling fluid to exit the second gap.

The at least one intermediate wall may comprise a first intermediate wall. The at least one pressure side supply cavity may comprise first and second pressure side supply cavities, wherein the first intermediate wall is positioned between the first and second pressure side supply cavities.

The first intermediate wall may comprise at least one bore for allowing cooling fluid to pass from the first pressure side supply cavity to the second pressure side supply cavity.

The at least one intermediate wall may further comprise second and third intermediate walls. The at least one suction side supply cavity may comprise first and second suction side supply cavities. The second intermediate wall may be positioned between the first pressure side supply cavity and the first suction side supply cavity. The third intermediate wall may be positioned between the first and second suction side supply cavities.

The second intermediate wall prevents cooling fluid from passing between the first pressure side supply cavity and the first suction side supply cavity. The third intermediate wall may comprise at least one bore for allowing cooling fluid to pass from the first suction side supply cavity to the second suction side supply cavity.

The airfoil may further comprise a plurality of pedestals extending between the first and second walls.

Preferably, the first gap extends from generally the leading edge of the first wall to generally the trailing edge of the first wall and the second gap extends from generally the trailing edge of the first wall to generally the leading edge of the first wall.

The pressure side of the first wall may comprise a plurality of first exit openings spaced apart so as to extend along a substantial portion of a length of the pressure side. The suction side of the first wall may comprise a plurality of second exit openings spaced apart and located between a middle section on the suction side to the leading edge of the first wall. The suction side preferably does not include second exit openings from the middle section on the suction side to the trailing edge of the first wall.

In accordance with a second aspect of the present invention, a vane is provided for a turbine of a gas turbine engine. The vane comprises: first and second endwalls and an airfoil. The airfoil comprises: an outer structure comprising a first wall including a leading edge, a trailing edge, a pressure side, and a suction side; an inner structure comprising a second wall spaced from the first wall, and at least one intermediate wall; and structure extending between the first and second walls so as to define first and second gaps between the first and second walls. The second wall and the at least one intermediate wall may define at least one pressure side supply cavity for receiving a cooling fluid to cool at least a portion of the pressure side of the first wall and at least one suction side supply cavity for receiving a cooling fluid to cool at least a portion of the suction side of the first wall.

The structure extending between the first and second walls may define the first and second gaps between the first and second walls such that the first gap may extend from generally the leading edge of the first wall toward the trailing edge of the first wall and may be defined at least in part by the pressure side of the first wall. The second gap may extend from generally the trailing edge of the first wall toward the leading edge of the first wall and may be defined at least in part by the suction side of the first wall.

The second wall may include at least one first opening near the leading edge of the first wall. The first opening may extend from the at least one pressure side supply cavity to the first gap. The second wall may also include at least one second opening near the trailing edge of the outer structure. The second opening may extend from the at least one suction side supply cavity to the second gap.

The first wall may comprise at least one first exit opening extending from the first gap through the pressure side of the first wall so as to allow cooling fluid to exit the first gap and at least one second exit opening extending from the second gap through the suction side of the second wall so as to allow cooling fluid to exit the second gap.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
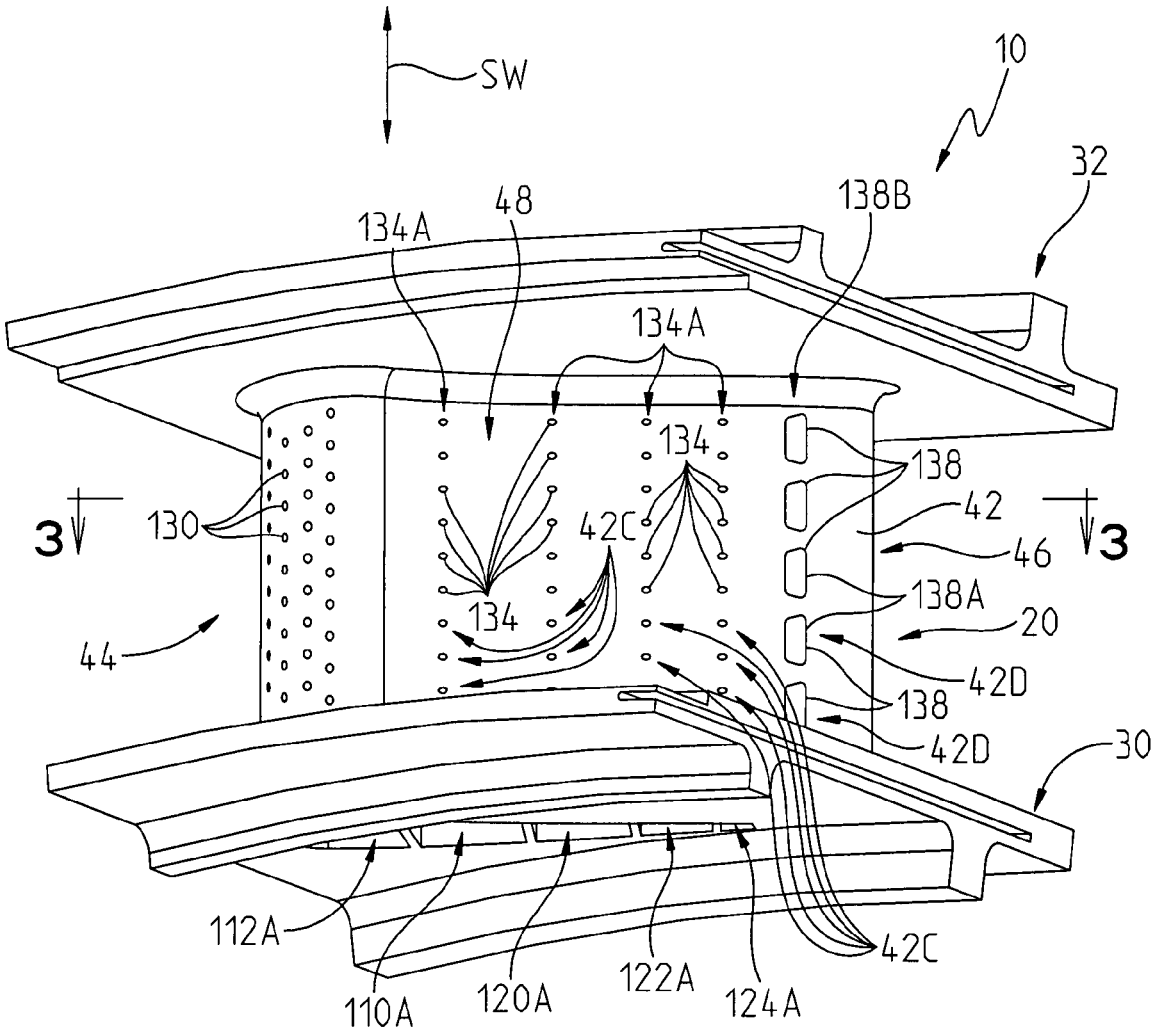
FIG. 1 is a perspective view of a vane of the present invention illustrating a pressure side of an airfoil of the vane.
Figure 2:
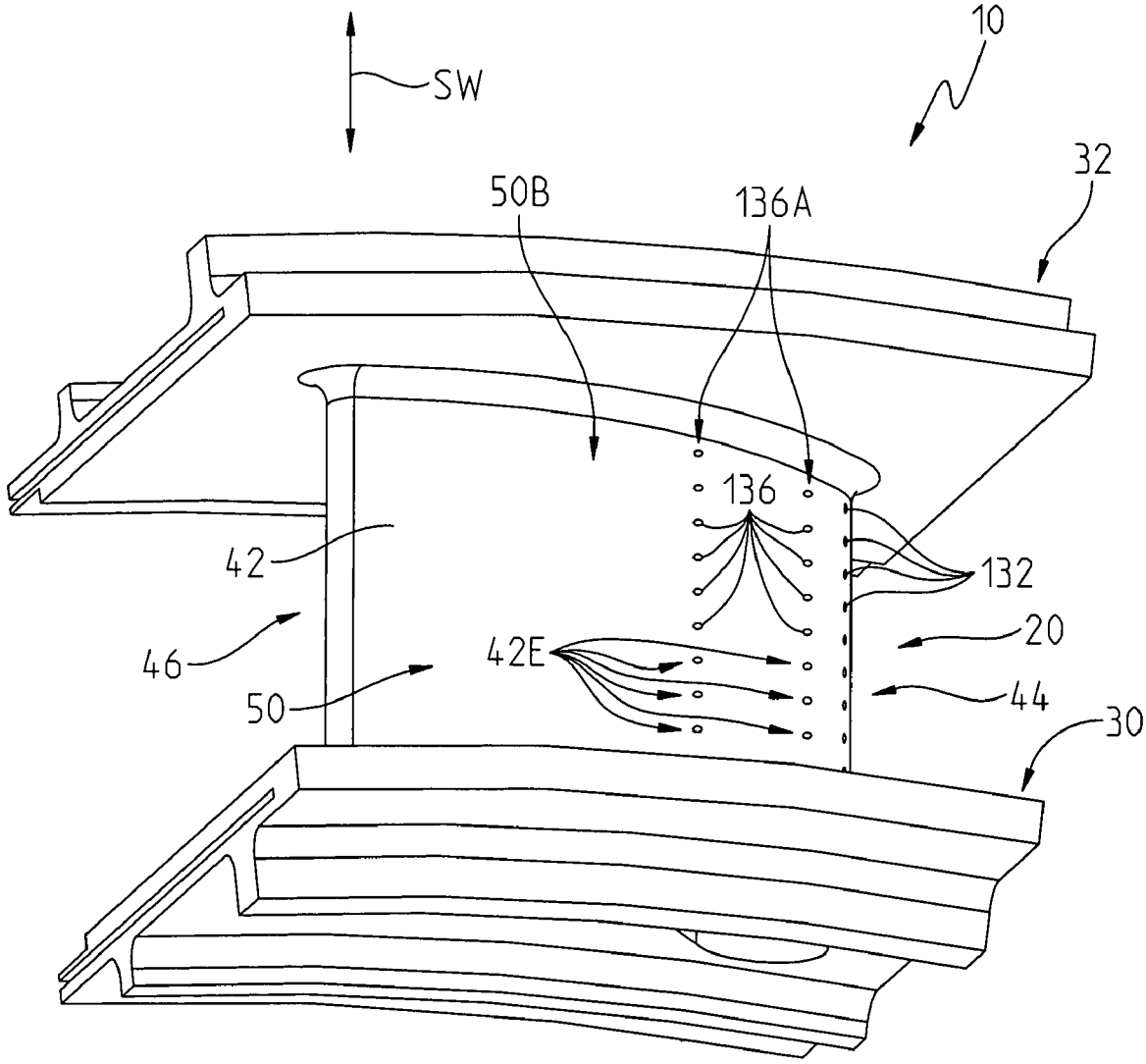
FIG. 2 is a perspective view of the vane in FIG. 1 illustrating a suction side of the airfoil.

Referring now to FIGS. 1 and 2, a vane 10 constructed in accordance with the present invention is illustrated. The vane 10 is adapted to be used in a gas turbine (not shown) of a gas turbine engine (not shown). The gas turbine engine includes a compressor (not shown), a combustor (not shown), and a turbine (not shown). The compressor compresses ambient air. The combustor combines compressed air with a fuel and ignites the mixture creating combustion products defining a high temperature working gas. The high temperature working gases travel to the turbine. Within the turbine are a series of rows of stationary vanes and rotating blades. Each pair of rows of vanes and blades is called a stage. Typically, there are four stages in a turbine. It is contemplated that the vane 10 illustrated in FIGS. 1 and 2 may define the vane configuration for a first row of vanes in the turbine.

The stationary vanes and rotating blades are exposed to the high temperature working gases. To cool the vanes and blades, a cooling fluid, such as air, from the compressor is provided to the vanes and the blades.

The vane 10 is defined by an airfoil 20 and first and second endwalls 30 and 32, respectively, see FIG. 1. The airfoil 20 comprises an outer structure 40 and an inner structure 60, see FIG. 3. The outer structure 40 comprising a first wall 42 defining a leading edge 44, a trailing edge 46, a concave-shaped pressure side 48, and a convex-shaped suction side 50. The inner structure 60 comprises a second wall 62 spaced from the first wall 42 and first, second, third and fourth intermediate walls 64, 66, 68 and 70. The first and second walls 42 and 62 and the intermediate walls 64, 66, 68 and 70 span the entire distance between the first and second endwalls 30 and 32. The airfoil 20 further comprises structure 80 extending between the inner and outer structures 40 and 60, which, in the illustrated embodiment, comprises first and second walls 80A and 80B. The walls 80A and 80B span the entire distance between the first and second endwalls 30 and 32 and define first and second gaps $G_1$ and $G_2$ between the first and second walls 42 and 62, see FIG. 3. Preferably, the first gap $G_1$ extends from generally the leading edge 44 of the first wall 42 to generally the trailing edge 46 of the first wall 42. Also, it is preferred that the second gap $G_2$ extend from generally the trailing edge 46 of the first wall 42 to generally the leading edge 44 of the first wall 42. The airfoil 20 further comprises a plurality of generally cylindrical pedestals 81 extending between the first and second walls 42 and 62, see FIGS. 3 and 4. The airfoil 20 and the first and second endwalls 30 and 32 may be formed as a single integral unit from a material such as a metal alloy 247 via a conventional casting operation. A conventional thermal barrier coating (not shown) is provided on an outer surface 42A of the first wall 42.

Figure 3:
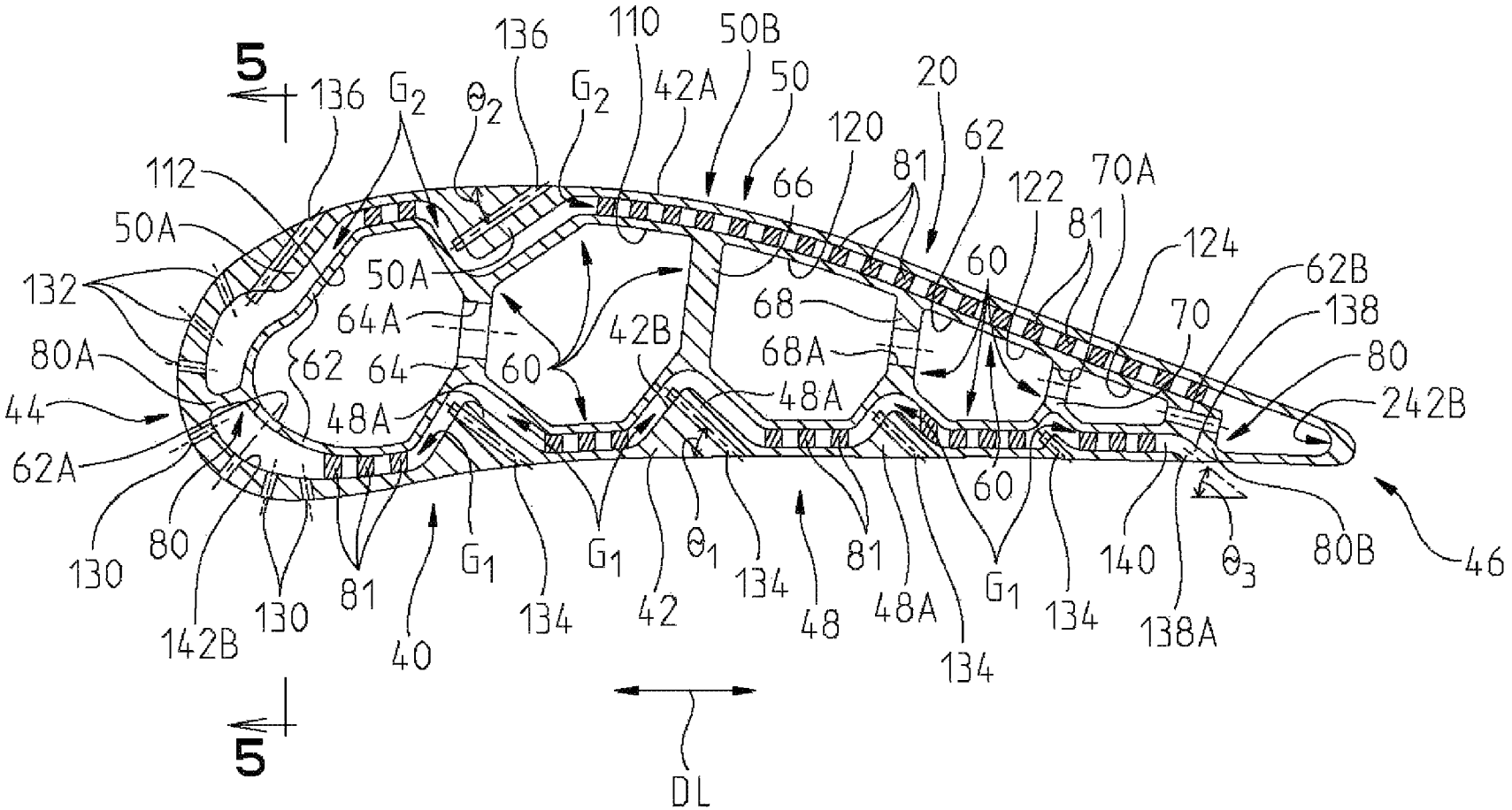
FIG. 3 is a sectional view taken along view line 3-3 in FIG. 1.
Figure 4:
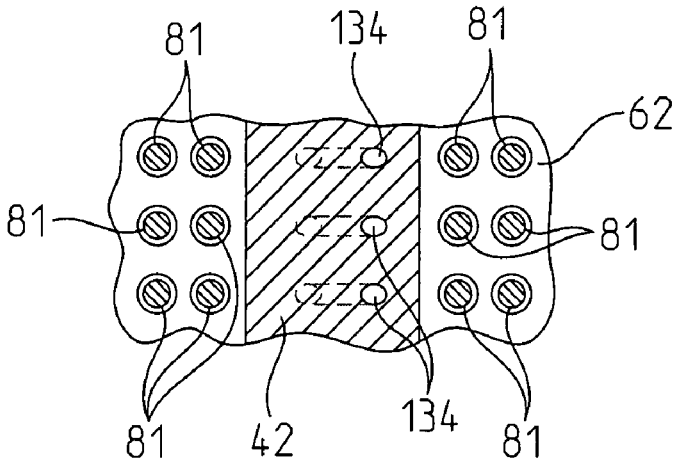
FIG. 4 is a side view of a portion of a second wall of the airfoil, a portion of a first wall of the airfoil in cross section with adjacent portions of the first wall removed and pedestals of the airfoil extending from the second wall.

First and second pressure side supply cavities 110 and 112, respectively, are defined by the second wall 62 and the first and second intermediate walls 64 and 66, see FIG. 3. First, second and third suction side supply cavities 120, 122 and 124, respectively, are defined by the second wall 62 and the second, third and fourth intermediate walls 66, 68 and 70.

Figure 5:
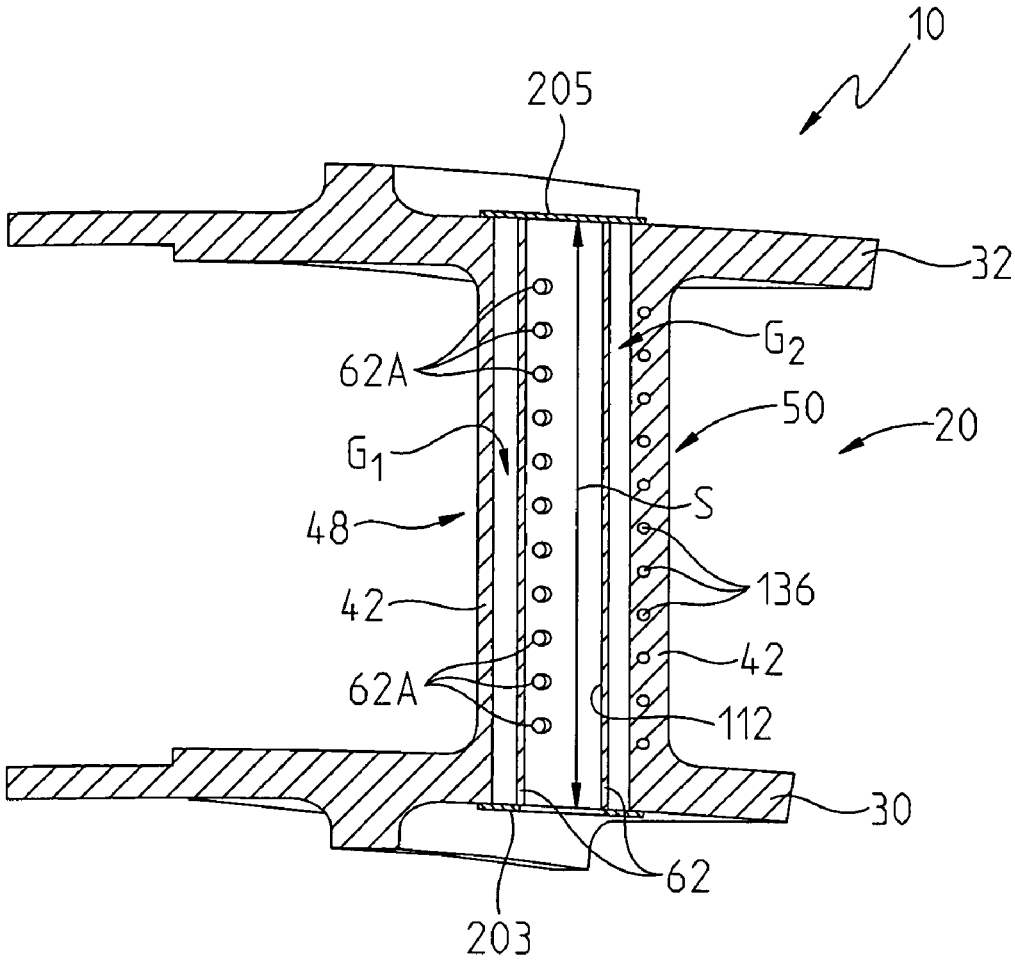
FIG. 5 is a cross sectional view taken along the entire span of the vane at a location corresponding to view line 5-5 in FIG. 3.

After casting of the vane 10, the first and second gaps $G_1$ and $G_2$ are closed via plates 203 and 205, shown only in FIG. 5, coupled to the first and second endwalls 30 and 32. In the illustrated embodiment, openings 110A, 112A, 120A, 122A and 124A are provided in the first endwall 30 to allow cooling fluid to enter supply cavities 110, 112, 120, 122 and 124, respectively, see FIG. 1. The first and second pressure side supply cavities 110 and 112, and the first, second and third suction side supply cavities 120, 122 and 124 are closed via the plate 205 coupled to the second endwall 32. It is also contemplated that the openings 120A, 122A and 124A, instead of being provided in the first endwall 30, may be provided in the second endwall 32. In this embodiment, the openings 110A and 112A remain in the first endwall 30. Hence, the supply cavities 120, 122, and 124 are closed via one or more plates (not shown) coupled to the first endwall 30 and the supply cavities 110A and 112A are closed via one or more plates (not shown) coupled to the second endwall 32.

The first intermediate wall 64 is provided with a plurality of bores 64A (only one of the bores 64A is illustrated in FIG. 3) which extend in a spanwise direction, wherein the spanwise direction is designated by arrow SW in FIGS. 1 and 2. The bores 64A may be spaced apart and extend substantially the entire span of the first intermediate wall 64 from near the first endwall 30 to near the second endwall 32 or may extend along only a portion of the span of the first intermediate wall 64. The third intermediate wall 68 is provided with a plurality of bores 68A (only one of the bores 68A is illustrated in FIG. 3) which extend in the spanwise direction SW. The bores 68A may be spaced apart and extend substantially the entire span of the third intermediate wall 68 from near the first endwall 30 to near the second endwall 32 or may extend along only a portion of the span of the third intermediate wall 68. The fourth intermediate wall 70 is provided with a plurality of bores 70A (only one of the bores 70A is illustrated in FIG. 3) which extend in the spanwise direction SW. The bores 70A may be spaced apart and extend substantially the entire span of the fourth intermediate wall 70 from near the first endwall 30 to near the second endwall 32 or may extend along only a portion of the span of the fourth intermediate wall 70. In the illustrated embodiment, the second intermediate wall 66 is substantially solid such that it has no bores extending through it. The second intermediate wall 66 prevents pressurized cooling fluid from moving from the first pressure side supply cavity 110 into the first suction side supply cavity 120 and vice versa. The bores 64A, 68A and 70A may have a circular or similar cross section.

The second wall 62 is provided with one or more first openings 62A extending from the second pressure side supply cavity 112 to the first gap $G_1$, see FIGS. 3 and 5. The first openings 62A extend completely through the second wall 62 and are positioned near the leading edge 44 of the first wall 42. A plurality of the first openings 62A may be spaced apart and extend substantially the entire span S of the second wall 62 from near the first endwall 30 to generally near the second endwall 32, see FIG. 5, or may extend along only a portion of the span of the second wall 62. The first openings 62A may have a circular or similar cross section.

The second wall 62 is also provided with one or more second openings 62B (only one of the openings 62B is illustrated in FIG. 3) extending from the third suction side supply cavity 124 to the second gap $G_2$, see FIG. 3. The second openings 62B extend completely through the second wall 62 and are positioned near the trailing edge 46 of the first wall 42. A plurality of the second openings 62B may be spaced apart and extend substantially the entire span S of the second wall 62 from near the first endwall 30 to near the second endwall 32 or may extend along only a portion of the span of the second wall 62. The second openings 62B may have a circular or similar cross section.

A plurality of first and second bores 130 and 132 extend through the leading edge 44 of the first wall 42 so as to allow cooling fluid to exit the first and second gaps $G_1$ and $G_2$ at the leading edge, see FIG. 3. In the illustrated embodiment, the first and second bores 130 and 132 are generally cylindrical in shape and generally circular in cross section. The first and second bores 130 and 132 may extend generally perpendicular to the outer surface 42A of the first wall 42 or at an angle to the first wall outer surface 42A.

A plurality of third bores 134 extend from the first gap $G_1$ through enlarged sections 48A of the pressure side 48 of the first wall 42 so as to allow cooling fluid to exit the first gap $G_1$, see FIGS. 1 and 3. In the illustrated embodiment, a plurality of rows 134A of the third bores 134 are spaced apart in a lengthwise direction, wherein the lengthwise direction is designated by arrow $D_L$ in FIG. 3, such that the rows 134A extend along a substantial portion of the length of the pressure side 48 of the first wall 42, see FIG. 1. The bores 134 in each row 134A may be spaced apart and extend substantially the entire span of the first wall 42 from near the first endwall 30 to near the second endwall 32 or may extend along only a portion of the span of the first wall 42. The length of the pressure side 48 of the first wall 42 extends from the leading edge 44 to the trailing edge 46. Also in the illustrated embodiment, the third bores 134 are generally cylindrical in shape, generally circular in cross section and extend relative to the outer surface 42A of the first wall 42 at an angle $\theta_1$ of from about 30 to about 50 degrees, see FIG. 3. It is also contemplated that the third bores 134 may have a square, rectangular or other cross sectional shape.

A plurality of fourth bores 136 extend from the second gap $G_2$ through enlarged sections 50A of the suction side 50 of the first wall 42 so as to allow cooling fluid to exit the second gap $G_2$, see FIGS. 2, 3 and 5. In the illustrated embodiment, a plurality of rows 136A of the fourth bores 136 are spaced apart in the lengthwise direction $D_L$ between the leading edge 44 of the first wall 42 and a middle section 50B of the suction side 50 of the first wall 42, see FIGS. 2 and 3. The bores 136 in each row 136A may be spaced apart and extend substantially the entire span of the first wall 42 from near the first endwall 30 to near the second endwall 32 or may extend along only a portion of the span of the first wall 42. Also in the illustrated embodiment, the fourth bores 136 are generally cylindrical in shape, generally circular in cross section and extend relative to the outer surface 42A of the first wall 42 at an angle $\theta_2$ of from about 30 to about 50 degrees, see FIG. 3. It is also contemplated that the fourth bores 136 may have a square, rectangular or other cross sectional shape.

A plurality of trailing end openings 138 extend through the pressure side 48 of the first wall 42 at an angle $\theta_3$ of from about 15 to about 25 degrees relative to the outer surface 42A of the first wall 42, see FIGS. 1 and 3. In the illustrated embodiment, a single row 138B of the trailing end openings 138 is located near the trailing edge 46 of the first wall 42 and communicate with an end 140 of the first gap $G_1$. In the illustrated embodiment, each opening 138 defines an exit 138A having a generally trapezoidal shape, see FIG. 1.

A pressurized cooling fluid provided by the compressor, such as air, enters the first and second pressure side supply cavities 110 and 112 through the corresponding openings 110A and 112A in the first endwall 30, see FIG. 1. The cooling fluid that enters the first pressure side supply cavity 110 moves into the second pressure side supply cavity 112 via the bores 64A provided in the first intermediate wall 64. From the second pressure side supply cavity 112, the cooling fluid passes through the first openings 62A in the second wall 62 into the first gap $G_1$. As the cooling fluid passes through the first openings 62A, it is metered by the first openings 62A such that the cooling fluid exiting each opening 62A impinges upon a corresponding portion 142B of an inner surface 42B of the first wall 42 to effect cooling of that portion 142B.

A portion of the cooling fluid entering into the first gap $G_1$ exits the first gap $G_1$ via the first bores 130. Other portions of the cooling fluid move through the first gap G1, impinge upon one or more of the enlarged sections 48A of the pressure side 48 of the first wall 42, and pass across the inner surface 42B of the pressure side 48 of the first wall 42 and over the pedestals 81 located between the pressure side 48 of the first wall 42 and the second wall 62. As the cooling fluid impinges upon one or more of the enlarged sections 48A of the pressure side 48 of the first wall 42, heat is transferred from the first wall 42 to the cooling fluid. Further, as cooling fluid moves across the inner surface 42B of the first wall 42 and the pedestals 81, the cooling fluid convectively cools the first wall 42 and the pedestals 81. Heat is transferred from the first wall 42 to the pedestals 81 via conduction. The portions of the cooling fluid entering into the first gap $G_1$ that do not exit through the first bores 130 exit the first gap $G_1$ through the third bores 134 and the trailing end openings 138.

Hence, the cooling fluid enters the first gap $G_1$ via the openings 62A near the leading end 44 of the first wall 42 and a portion of that cooling fluid moves substantially the entire length of the pressure side 48 of the first wall 42 as it travels through the first gap $G_1$ prior to exiting the first gap $G_1$ via the trailing end openings 138.

Because the third bores 134 are positioned at angle $\theta_1$ relative to the outer surface 42A of the first wall 42, it is believed that cooling fluid leaving each third bore 134 will form a film of cooling air along a corresponding downstream portion 42C of, the outer surface 42A of the first wall 42, see FIG. 1. Further, because the trailing end openings 138 are positioned at angle $\theta_3$ relative to the outer surface 42A of the first wall 42, it is believed that cooling fluid leaving each opening 138 will form a film of cooling air along a corresponding downstream portion 42D of the outer surface 42A of the first wall 42, see FIG. 1.

The static pressure of the high temperature working gases on the pressure side 48 of the first wall 42 is high, i.e., higher than on the suction side 50 of the first wall 42. Hence, it more difficult to discharge cooling fluid from the pressure side 48 than on the suction side 50 of the first wall 42. Consequently, in the illustrated embodiment, the rows 134A of the third bores 134 extend along a substantial portion of the length of the pressure side 48 of the first wall 42 to ensure that a sufficient amount of cooling fluid is discharged onto the outer surface 42A of the pressure side 48 of the first wall 42.

A pressurized cooling fluid provided by the compressor, such as air, enters the first, second and third suction side supply cavities 120, 122 and 124 through the corresponding openings 120A, 122A and 124A in the first endwall 30, see FIG. 1. The cooling fluid that enters the first suction side supply cavity 120 moves into the second suction side supply cavity 122 via the bores 68A provided in the third intermediate wall 68. The cooling fluid that enters the second suction side supply cavity 122 moves into the third suction side supply cavity 124 via the bores 70A provided in the fourth intermediate wall 70. From the third suction side supply cavity 124, the cooling fluid passes through the second openings 62B in the second wall 62 into the second gap $G_2$. The cooling fluid is metered by the second openings 62B such that cooling fluid exiting each opening 62B impinges upon a corresponding portion 242B of the inner surface 42B of the first wall 42 to effect cooling of that portion 242B.

After entering into the second gap $G_2$, the cooling fluid moves through the second gap $G_2$ such that it passes across the inner surface 42B of the suction side 50 of the first wall 42 and over the pedestals 81 located between the suction side 50 of the first wall 42 and the second wall 62, and impinges upon one or more of the enlarged sections 50A of the suction side 50 of the first wall 42. As cooling fluid moves across the inner surface 42B of the first wall 42 and the pedestals 81, the cooling fluid convectively cools the first wall 42 and the pedestals 81. Further, as the cooling fluid impinges upon the enlarged sections 50A of the suction side 50 of the first wall 42, heat is transferred from the first wall 42 to the cooling fluid. Cooling fluid passing through the second gap $G_2$ exits the second gap $G_2$ through the fourth bores 136 and the second bores 132.

Hence, cooling fluid enters the second gap $G_2$ via the openings 62B near the trailing end 46 of the first wall 42 and moves substantially the entire length of the suction side 50 of the first wall 42 as it travels through the second gap $G_2$ prior to exiting the second gap $G_2$ via the fourth bores 136 and the second bores 132.

Because the fourth bores 136 are positioned at angle $\theta_2$ relative to the outer surface 42A of the first wall 42, it is believed that cooling fluid leaving each fourth bore 136 will form a film of cooling fluid along a corresponding downstream portion 42E of the outer surface 42A of the first wall 42, see FIG. 2. Further, because the static pressure of the high temperature working gases on the suction side 50 of the first wall 42 is low, i.e., lower than on the pressure side 48 of the first wall 42, it is believed that a substantial amount of cooling fluid may be discharged by the fourth bores 136 so as to form a film of cooling fluid extending from the rows 136A of the fourth bores 136 to the trailing edge 46 of the first wall 42 including the portion of the suction side 50 extending from the middle section 50B of the suction side 50 to the trailing edge 46.

It is noted that the high temperature working gases first strike the airfoil 20 at or near the leading edge 44 of the first wall 42. The heat load on the airfoil 20, due to the high temperature working gases striking and moving about the airfoil 20, is greatest at the leading edge 44. Also, static pressure applied by the high temperature working gases to the airfoil 20 is greatest at the leading edge 44 of the first wall 42. Film cooling of the outer surface 42A of the first wall 42 at the leading edge 44 is effected by fresh cooling fluid exiting the first gap $G_1$ through the first bores 130. Further film cooling of the outer surface 42A of the first wall 42 at the leading edge 44 is effected by cooling fluid exiting the second gap $G_2$ through the second bores 132. Convective cooling of the inner surface 42B of the leading edge 44 of the first wall 42 is effected via fresh cooling fluid exiting the first openings 62A in the second wall 62 and impinging upon corresponding portions 142B of the inner surface 42B of the first wall 42. Additional convective cooling of the inner surface 42B of the leading edge 44 of the first wall 42 is effected via cooling fluid passing through the first and second gaps $G_1$ and $G_2$ and moving across the inner surface 42B of the leading edge 44 of the first wall 42 such that heat is transferred from the first wall 42 to the cooling fluid.

The heat load on the trailing edge 46 of the first wall 42 is less than the heat load on the leading edge 44, but is still substantial such that the second highest heat load location on the first wall 42 may be at the trailing edge 46. Convective cooling of the inner surface 42B of the trailing edge 46 of the first wall 42 is effected via fresh cooling fluid exiting the second openings 62B in the second wall 62 and impinging upon corresponding portions 242B of the inner surface 42B of the first wall 42. Film cooling of the outer surface 42A of the trailing edge 46 of the first wall 42 is effected by cooling fluid exiting the trailing end openings 138 and the fourth bores 136.

Hence, in the present invention, fresh or yet-to-be-used cooling fluid is delivered where the heat load is greatest on the first wall 42, i.e., at the leading and trailing edges 44 and 46 of the first wall 42. Fresh cooling fluid is provided by the compressor to the first and second pressure side supply cavities 110 and 112. That cooling fluid is metered by the first openings 62A in the second wall 62 such that the fresh cooling fluid from the second supply cavity 112 impinges directly onto corresponding portions 142B of the inner surface 42B of the leading edge 44 of the first wall 42. Further, fresh cooling fluid is provided by the compressor to the first, second and third suction side supply cavities 120, 122 and 124. That cooling fluid is metered by the second openings 62B in the second wall 62 such that the fresh cooling fluid from the third supply cavity 124 impinges directly onto corresponding portions 242B of the inner surface 42B of the trailing edge 46 of the first wall 42. Consequently, the cooling fluid, when at its lowest temperature, is provided to the areas on the first wall 42 having the greatest heat loads, i.e., the leading and trailing edges 44 and 46 of the first wall 42.

A minimum throat or throughput area exists between a pair of adjacent vanes 10 of a given stage within a turbine through which high temperature working gases pass, see published patent application, U.S. 2006/0275119 A1, entitled VORTEX COOLING FOR TURBINE BLADES, by George Liang, filed on Jan. 3, 2006, the entire disclosure of which is incorporated herein by reference. The minimum throughput area may be defined by a gage point or area on a suction side 50 of a first airfoil and a trailing edge of an adjacent second airfoil. Discharging cooling fluid downstream of a gage point on a given airfoil, i.e., from the gage point to the trailing edge 46 of the first wall 42, may result in an undesirable amount of mixing between the discharged cooling fluid and the high temperature working gases, which can result in an undesirable reduction in aerodynamic performance. In the present invention, cooling fluid is not discharged at a location between the middle section 50B of the suction side 50 of the first wall 42 and the trailing edge 46 of the first wall 42. The gage point of the airfoil 20 may be located near the middle section 50B of the suction side 50 of the first wall 42 in the illustrated embodiment. Consequently, in the illustrated embodiment, there are no rows 136A of fourth bores 136 provided between the middle section 50B of the suction side 50 of the first wall 42 and the trailing edge 46 of the first wall 42.

It is believed that a significant amount of cooling of the portion of the suction side 50 of the first wall 42 extending from the middle section 50B to the trailing edge 46 occurs by way of internal convective cooling. As noted above, cooling fluid, after entering into the second gap $G_2$, moves through the second gap $G_2$ and passes across the inner surface 42B of the suction side 50 of the first wall 42 and over the pedestals 81 located between the suction side 50 of the first wall 42 and the second wall 62. As the cooling fluid moves across the inner surface 42B of the suction side 50 of the first wall 42 and the pedestals 81, the cooling fluid convectively cools the first wall 42 and the pedestals 81. It is also believed that some amount of cooling of the portion of the suction side 50 of the first wall 42 extending from the middle section 50B to the trailing edge 46 occurs by way of external film cooling via the cooling fluid discharged by the fourth bores 136.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a turbine of a gas turbine engine comprising:

an outer structure comprising a first wall including a leading edge, a trailing edge, a pressure side, and a suction side;

an inner structure comprising a second wall spaced from said first wall and at least one intermediate wall, said second wall and said at least one intermediate wall defining at least one pressure side supply cavity for receiving a cooling fluid to cool at least a portion of said pressure side of said first wall and at least one suction side supply cavity for receiving a cooling fluid to cool at least a portion of said suction side of said first wall;

structure extending between said first and second walls so as to define first and second gaps between said first and second walls, said first gap extending from generally said leading edge of said first wall toward said trailing edge of said first wall and being defined at least in part by said pressure side of said first wall, and said second gap extending from generally said trailing edge of said first wall toward said leading edge of said first wall and being defined at least in part by said suction side of said first wall;

said second wall including at least one first opening near said leading edge of said first wall and extending from said at least one pressure side supply cavity to said first gap and at least one second opening near said trailing edge of said first wall and extending from said at least one suction side supply cavity to said second gap, said at least one first opening being located only near said leading edge such that cooling fluid is only delivered to said first gap near said leading edge and said at least one second opening is located only near said trailing edge such that cooling fluid is only delivered to said second gap near said trailing edge; and said first wall comprising at least one first exit opening extending from said first gap through said pressure side of said first wall near said trailing edge so as to allow cooling fluid to exit said first gap near said trailing edge and at least one second exit opening extending from said second gap through said suction side of said second wall so as to allow cooling fluid to exit said second gap.

2. The airfoil of claim 1, wherein said at least one intermediate wall comprises a first intermediate wall, said at least one pressure side supply cavity comprises first and second pressure side supply cavities and said first intermediate wall being positioned between said first and second pressure side supply cavities.

3. The airfoil of claim 2, wherein said first intermediate wall comprising at least one bore for allowing cooling fluid to pass from said first pressure side supply cavity to said second pressure side supply cavity.

4. The airfoil of claim 3, wherein said at least one intermediate wall further comprises second and third intermediate walls, said at least one suction side supply cavity comprises first and second suction side supply cavities, said second intermediate wall being positioned between said first pressure side supply cavity and said first suction side supply cavity, said third intermediate wall being positioned between said first and second suction side supply cavities.

5. The airfoil of claim 4, wherein said second intermediate wall prevents cooling fluid from passing between said first pressure side supply cavity and said first suction side supply cavity and said third intermediate wall comprising at least one bore for allowing cooling fluid to pass from said first suction side supply cavity to said second suction side supply cavity.

6. The airfoil of claim 1, further comprising a plurality of pedestals extending between said first and second walls.

7. The airfoil of claim 1, wherein said first gap extends continuously from generally said leading edge of said first wall to generally said trailing edge of said first wall and said second gap extends continuously from generally said trailing edge of said first wall to generally said leading edge of said first wall.

8. The airfoil of claim 7, wherein said pressure side of said first wall comprises a plurality of first exit openings spaced apart so as to extend along a substantial portion of a length of said pressure side.

9. The airfoil of claim 8, wherein said suction side of said first wall comprises a plurality of second exit openings spaced apart and located between a middle section on said suction side to said leading edge of said first wall and said suction side does not include second exit openings from said middle section on said suction side to said trailing edge of said first wall.

10. A vane for a turbine of a gas turbine engine comprising: first and second endwalls; and an airfoil comprising:

an outer structure comprising a first wall including a leading edge, a trailing edge, a pressure side, and a suction side;

an inner structure comprising a second wall spaced from said first wall and at least one intermediate wall, said second wall and said at least one intermediate wall defining at least one pressure side supply cavity for receiving a cooling fluid to cool at least a portion of said pressure side of said first wall and at least one suction side supply cavity for receiving a cooling fluid to cool at least a portion of said suction side of said first wall;

structure extending between said first and second walls so as to define first and second gaps between said first and second walls, said first gap extending from generally said leading edge of said first wall toward said trailing edge of said first wall and being defined at least in part by said pressure side of said first wall, and said second gap extending continuously from generally said trailing edge of said first wall to near said leading edge of said first wall and being defined at least in part by said suction side of said first wall;

said second wall including at least one first opening extending from said at least one pressure side supply cavity to said first gap such that cooling fluid is delivered from said at least one pressure side supply cavity to said first gap and cooling fluid from said pressure side supply cavity is not provided to said second gap and said second wall further including at least one second opening extending from said at least one suction side supply cavity to said second gap; and said first wall comprising at least one first exit opening extending from said first gap through said pressure side of said first wall so as to allow cooling fluid to exit said first gap and at least one second exit opening extending from said second gap through said suction side of said second wall near said leading edge so as to allow cooling fluid to exit said second gap near said leading edge.

11. The vane of claim 10, wherein said at least one intermediate wall comprises a first intermediate wall, said at least one pressure side supply cavity comprises first and second pressure side supply cavities and said first intermediate wall being positioned between said first and second pressure side supply cavities.

12. The vane of claim 11, wherein said first intermediate wall comprising at least one bore for allowing cooling fluid to pass from said first pressure side supply cavity to said second pressure side supply cavity.

13. The vane of claim 12, wherein said at least one intermediate wall further comprises second and third intermediate walls, said at least one suction side supply cavity comprises first and second suction side supply cavities, said second intermediate wall being positioned between said first pressure side supply cavity and said first suction side supply cavity, said third intermediate wall being positioned between said first and second suction side supply cavities.

14. The vane of claim 13, wherein said second intermediate wall prevents cooling fluid from passing between said first pressure side supply cavity and said first suction side supply cavity and said third intermediate wall comprising at least one bore for allowing cooling fluid to pass from said first suction side supply cavity to said second suction side supply cavity.

15. The vane of claim 10, further comprising a plurality of pedestals extending between said first and second walls.

16. The vane of claim 10, wherein said first gap extends continuously from generally said leading edge of said first wall to generally said trailing edge of said first wall and said second gap extends continuously from generally said trailing edge of said first wall to generally said leading edge of said first wall.

17. The vane of claim 16, wherein said pressure side of said first wall comprises a plurality of first exit openings spaced apart so as to extend along a substantial portion of a length of said pressure side and said suction side of said first wall comprises a plurality of second exit openings spaced apart and located between a middle section on said suction side to said leading edge of said first wall.

18. The vane of claim 17, wherein said suction side does not include second exit openings from said middle section on said suction side to said trailing edge of said first wall.

19. The vane of claim 10, wherein said at least one second opening extends from said at least one suction side supply cavity to said second gap such that cooling fluid is delivered from said at least one suction side supply cavity to said second gap and cooling fluid from said suction side supply cavity is not provided to said first gap.

* * * * *